US010746415B2

(12) United States Patent
Sørensen et al.

(10) Patent No.: US 10,746,415 B2
(45) Date of Patent: Aug. 18, 2020

(54) METHOD FOR ADJUSTING THE SETPOINT TEMPERATURE OF A HEAT TRANSFER MEDIUM

(71) Applicant: GRUNDFOS HOLDING A/S, Bjerringbro (DK)

(72) Inventors: Erik Baasch Sørensen, Bjerringbro (DK); Hakon Børsting, Støvring (DK); Thomas Blad, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 584 days.

(21) Appl. No.: 14/513,771

(22) Filed: Oct. 14, 2014

(65) Prior Publication Data

US 2015/0102120 A1 Apr. 16, 2015

(30) Foreign Application Priority Data

Oct. 15, 2013 (EP) ..... 13188784

(51) Int. Cl.
*F24D 19/10* (2006.01)
*F24D 3/18* (2006.01)

(52) U.S. Cl.
CPC ..... *F24D 19/1039* (2013.01); *F24D 3/18* (2013.01); *F24D 19/1018* (2013.01);
(Continued)

(58) Field of Classification Search
CPC ..... F24D 19/1018; G05D 23/1931
See application file for complete search history.

(56) References Cited

U.S. PATENT DOCUMENTS 4,122,892 A * 10/1978 Delaporte ..... F24D 11/02 165/232
7,315,793 B2 * 1/2008 Jean ..... H05B 37/029 702/127

(Continued)

FOREIGN PATENT DOCUMENTS

DE 36 43 434 A1 6/1988
DE 195 07 247 A1 9/1996

(Continued)

OTHER PUBLICATIONS

Machine Translation of EP0594866A1, Google Patents, retrieved Mar. 4, 2017.*

*Primary Examiner* — Avinash A Savani
*Assistant Examiner* — Deepak A Deean
(74) *Attorney, Agent, or Firm* — McGlew and Tuttle, P.C.

(57) ABSTRACT

A method for adjusting the setpoint temperature of a heat transfer medium circulating in a heating or cooling system (9) inside a building or at least inside a surrounding part of a building. The heating or cooling circuit includes a plurality of heat transferring units, each with a temperature controlled valve. A sum opening degree (OD) of all temperature controlled valves is determined in a time dependent manner and a setpoint temperature $T_{w,ref}$ of heat transferring medium is controlled according to a predetermined sum opening degree (OD) of all temperature controlled valves. A heating system (9) is provided for supplying heat to a building or a part of the building via a liquid heat transfer medium circulated in a circuit. The heating system (9) includes heat transferring units, each being equipped with a temperature controlled valve. The system is controllable according to the method for adjusting the setpoint temperature.

4 Claims, 2 Drawing Sheets

(52) U.S. Cl.
CPC ..... *F24D 19/1036* (2013.01); *F24D 2200/12* (2013.01); *F24D 2220/20* (2013.01)

(56) References Cited

U.S. PATENT DOCUMENTS

| | | | | |
|---|---|---|---|---|
| 8,024,161 | B2 * | 9/2011 | Pekar | F24D 19/1015 700/281 |
| 2015/0293505 | A1 * | 10/2015 | Acosta Gonzalez | F04D 27/00 700/29 |

FOREIGN PATENT DOCUMENTS

| | | | |
|---|---|---|---|
| DE | 196 53 052 | A1 | 6/1998 |
| DE | 197 10 646 | A1 | 8/1998 |
| DE | 197 56 104 | A1 | 6/1999 |
| DE | 101 44 595 | A1 | 4/2003 |
| DE | 101 63 987 | A1 | 7/2003 |
| EP | 0 594 885 | A1 | 5/1994 |
| EP | 0 594 886 | A1 | 5/1994 |
| EP | 0 864 955 | A1 | 9/1998 |
| EP | 1 108 962 | A2 | 6/2001 |
| EP | 1 456 727 | A2 | 9/2004 |
| WO | 03/052536 | A2 | 6/2003 |

* cited by examiner

METHOD FOR ADJUSTING THE SETPOINT TEMPERATURE OF A HEAT TRANSFER MEDIUM

CROSS REFERENCE TO RELATED APPLICATIONS

This application claims the benefit of priority under 35 U.S.C. § 119 of European Patent Application EP 13 188 784.6 filed Oct. 15, 2013, the entire contents of which are incorporated herein by reference.

FIELD OF THE INVENTION

The invention relates to a method for adjusting the setpoint temperature of a heat transfer medium and to a heating system.

BACKGROUND OF THE INVENTION

In prior art, heat pumps are employed in heating systems for heating interior spaces in buildings. In order to maximize the efficiency of the heat pump, or specifically the so-called coefficient of performance (COP), a heating system should be chosen which requires only a low final water temperature, since the hotter the water delivered by the heat pump, the lower the COP will be. Thus, usually heat pumps are set so as to supply water as cold as possible while nevertheless providing the necessary heating energy in order to provide the desired room temperature in the area heated by the heating system.

However, the heating demand for heating interior spaces or rooms in a building changes with changing weather conditions. Thus, also the set-point for the water temperature needs to be changed accordingly depending on the outside temperature whereby the setpoint for the water temperature is determined by the heat curve on the basis of the outside temperature. Thus, in a normal control structure of a heat pump for e.g., a family house is such that the outside temperature $T_{out}$ is mapped to a setpoint for the water temperature $T_{w,ref}$ by the heat curve, and the compressor is adjusted such that the water temperature reaches the setpoint and a specific room temperature $T_n$ is achieved. As the shape of the heat curve, however, depends on factors such as the heating system and insulation, the user has to manually adjust the heat curve to each system in order to achieve the desired room temperature.

In order to provide feedback of the room temperature, it is known in prior art to employ a single temperature sensor. The temperature sensor provides feedback of the room temperature at a distinct single location in the house or room, respectively, which feedback is used to adjust the water temperature setpoint. This increases the comfort in the area surrounding the location of the temperature sensor and provides the ability to compensate for temperature changes.

However, this approach has the drawback that it only provides feedback with respect to a single location. If the temperature nearby the sensor rises due to free heat, the compensation in the water temperature can result in water which is too cold for heating areas with less free heat than at the location where the temperature sensor is arranged.

SUMMARY OF THE INVENTION

Thus, it is an object of the present invention to provide an improved method for automatically adjusting the setpoint temperature of a heat transfer medium circulating in a heating system, and corresponding heating system.

According to the present invention, a method for adjusting the setpoint temperature of a heat transfer medium circulating in a heating or cooling system inside a building or at least inside a surrounding part of a building is provided wherein the heating or cooling circuit comprises a plurality of heat transferring units each being equipped with a temperature controlled valve, characterized in that the sum opening degree of all temperature controlled valves is determined in a time dependent manner and the setpoint temperature of heat transferring medium is controlled according to a predetermined sum opening degree of all temperature controlled valves. According to the inventive method, the heat curve is adapted automatically based on the condition of the hydronic heating system whereby the desired indoor temperature is maintained in the entire house, i.e., in all areas to which heat is to be delivered, and not only at a single location. According to the inventive method, feedback from the heating system is provided which is used to adapt the water temperature setpoint to achieve the desired room temperature according to the outside temperature. Specifically, the estimation of the flow and head in the heating system provides a feedback of the average opening of all radiator valves or floor valves respectively in the heating system. The feedback by flow and head estimations is used to change the water temperature setpoint based on the actual need of the heating system. The water temperature is slowly adjusted to keep the temperature controlled valves at an opening degree at which they provide an optimal working condition. Also, the automatic adaptation eliminates the need for the user to manually adjust the heat curve.

According to a preferred embodiment, the time dependent sum valve opening degree is based on an actual estimated hydraulic system resistance compared with an estimated minimum and/or maximum hydraulic system resistance.

Further, the estimation of the minimum and/or maximum hydraulic system resistance may be based on estimated hydraulic systems valves registered in e.g., the last 5 to 25 days.

It is also advantageous, if the estimation of the minimum and/or maximum hydraulic system resistance is done by filtering peak values of the continuously determined hydraulic system resistance.

According to a further preferred embodiment, the setpoint temperature is also adjusted according to the outside temperature of the building. For this, a measurement of the outside temperature is provided to the heat pump which then estimates the flow and head of the system and uses it to change the output such that the heating system is maintained in an optimal operating condition.

Preferably, a heat transfer system comprises a heat compensation curve which outputs the setpoint temperature in relation to the outside temperature of the building.

Moreover, the setpoint temperature may be controlled based on the sum valve opening degree and the heat compensation curve.

The heat compensation curve may be adapted in dependency of the outside temperatures and the sum opening valve degree.

It is also preferred, if the sum opening degree of all temperature controlled valves is determined on the basis of the flow and/or the head through the heating or cooling circuit.

According to still a further preferred embodiment, the sum opening degree of all temperature controlled valves is determined by a pump of the heating system, especially by sensor based data and/or electrical data of the pump.

Preferably, there is a first phase when the minimum and maximum hydraulic system resistances are estimated and a second phase when the sum opening degree of all temperature controlled valves is determined.

According to the invention, there is also provided a heating system for supplying heat to a building or a part of the building by means of a liquid heat transfer medium circulated in a circuit, the heating system comprising a plurality of heat transferring units each being equipped with a temperature controlled valve wherein the system is controllable according to the above described method. The heating system which implements an automatic adaptation of the heat curve according to changes in free heat provides the advantages already discussed above. Specifically, the heating system may always be operated with a maximized COP while maintaining a comfortable temperature in all areas to be heated in a house or building.

The heating system preferably comprises a pump in which an adaptation algorithm is implemented, wherein the pump has a temperature sensor input for the temperature measured by an outside temperature sensor.

Further, the pump may have an output for a temperature which indicates the compensated outside temperature.

According to a preferred embodiment, the temperature controlled valves are thermostatic valves. The thermostatic valves are used to control the room temperature in all areas of a building. This provides feedback of the room temperature and thereby, the ability to compensate for changes in temperature resulting, e.g., from free heat.

The invention is not limited to the described embodiments which can be modified in many ways. Preferred embodiments of the present invention will now be more particularly described, by way of example, with reference to the accompanying drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
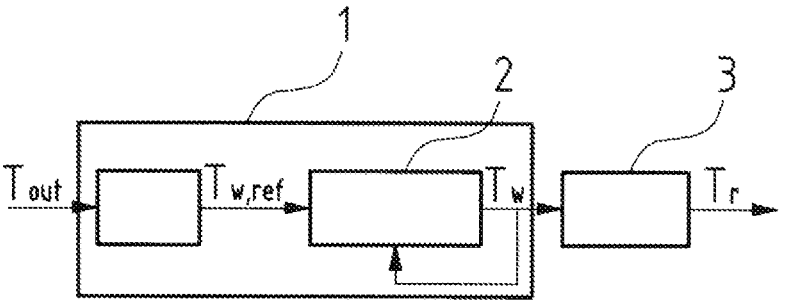
FIG. 1 is a view showing a normal control structure of a heat pump according to prior art.

Referring to the drawings in particular, FIG. 1 shows a normal control structure of a heat pump 1 which may be implemented in a single-family house, according to prior art. The outside temperature $T_{out}$ is mapped to a setpoint for the water temperature $T_{w,ref}$ by the heat curve, and the compressor 2 is adjusted such that the water temperature $T_w$ reaches the setpoint and a room temperature $T_r$ is achieved when the heating system 3 is operated. However, according to this implementation, the user has to manually adjust the heat curve to achieve the desired room temperature as the shape of the curve depends amongst other things on the type of heating system used and on the insulation of the house.

Figure 2:
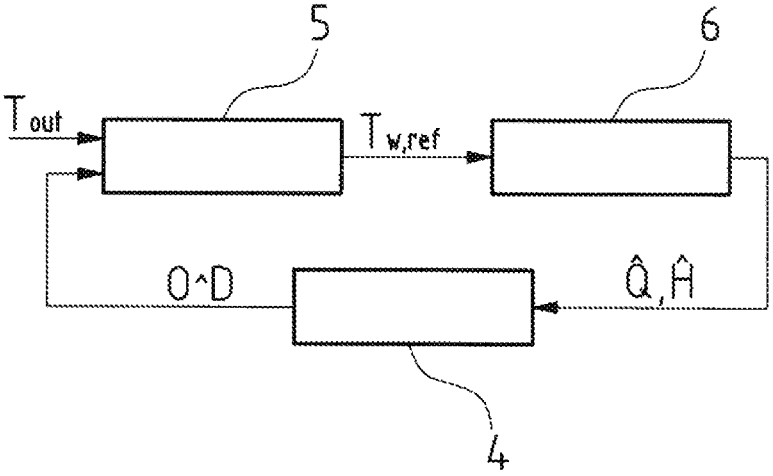
FIG. 2 is a view showing an overview of the control system for carrying out the method according to an embodiment of the present invention.

FIG. 2 shows an overview of a control system for carrying out the method according to an embodiment of the present invention. The embodiment shown in FIG. 2 illustrates the basic principle of a control system for carrying out the inventive method. The water temperature setpoint $T_{w,ref}$, which is supplied to the heat pump 6 of the heating system, is calculated based on the outside temperature $T_{out}$ measured, for example, by a temperature sensor placed outside the building, and the opening degree OD of the heating system is estimated by an opening degree estimation means 4. Specifically, the opening degree is calculated based on estimations of the flow Q and the head H which are input to the opening degree estimation means 4. Both values, the opening degree OD and the outside temperature $T_{out}$ are then used as input for adapting the adaptive heat curve 5. The heat curve 5 is thus automatically adapted to the need of the heating system.

Figure 3:
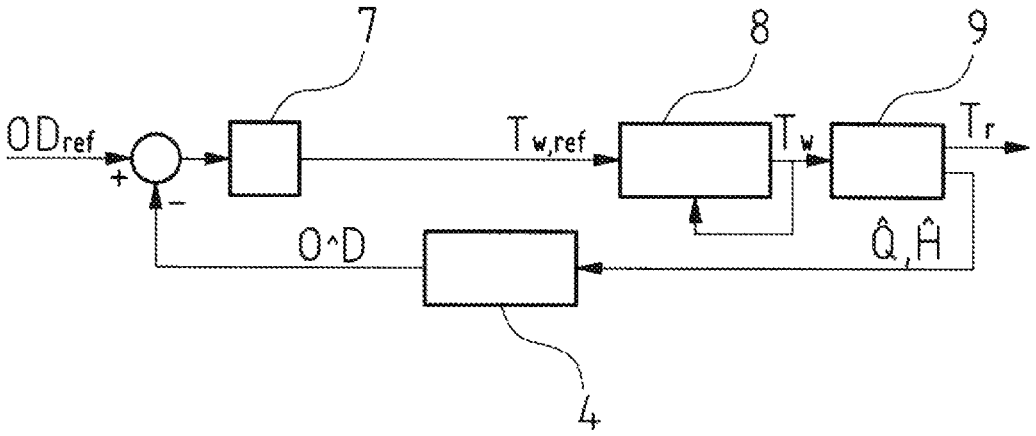
FIG. 3 is a view showing a control structure for a heat pump of a heating system according to the present invention.

FIG. 3 shows a control structure for a heat pump 6 of a heating system 9 according to the invention. In this case, the output from a regulator 7 uses a reference opening degree $OD_{ref}$ and an opening degree OD from an opening degree estimation means 4 arranged in a feedback loop to output the water temperature setpoint $T_{w,ref}$. The water temperature setpoint $T_{w,ref}$ then is fed to a compressor control 8 of the heat pump 6 which in turn outputs a water temperature value $T_w$ to the heating system 9.

Figure 4:
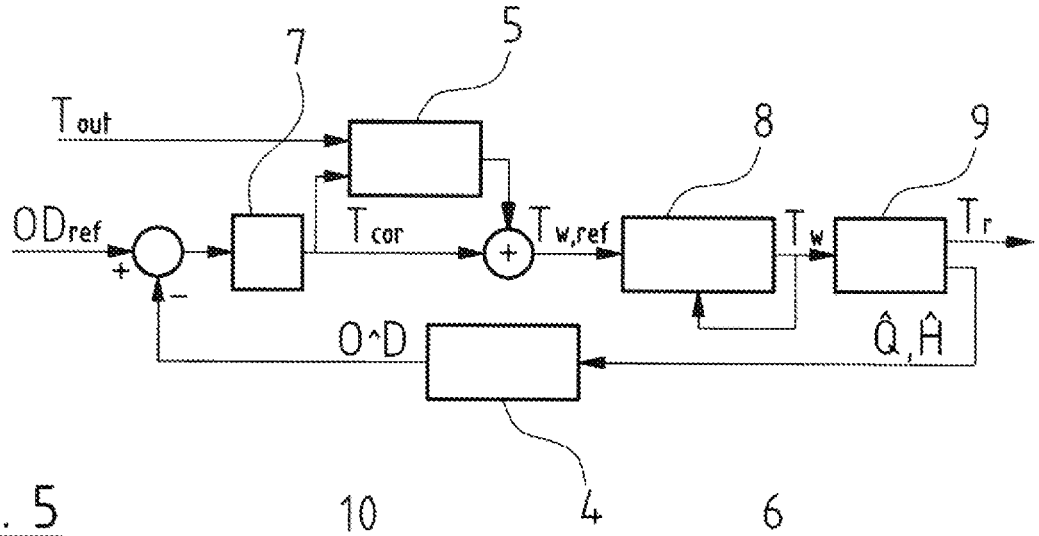
FIG. 4 is a view showing a control structure for a heat pump of a heating system according to still another embodiment of the present invention.

FIG. 4 shows a control structure for a heat pump 6 of a heating system 9 according to another embodiment of the present invention. According to this embodiment, feedback from the entire heating system 9 is used for the automatic adaptation of the heat curve 5 wherein Q indicates the measurement or the estimation of the flow, and H indicates the measurement or the estimation of the head of the system in order to calculate or estimate the opening degree OD of the radiators in an OD estimation means 4.

Figure 5:
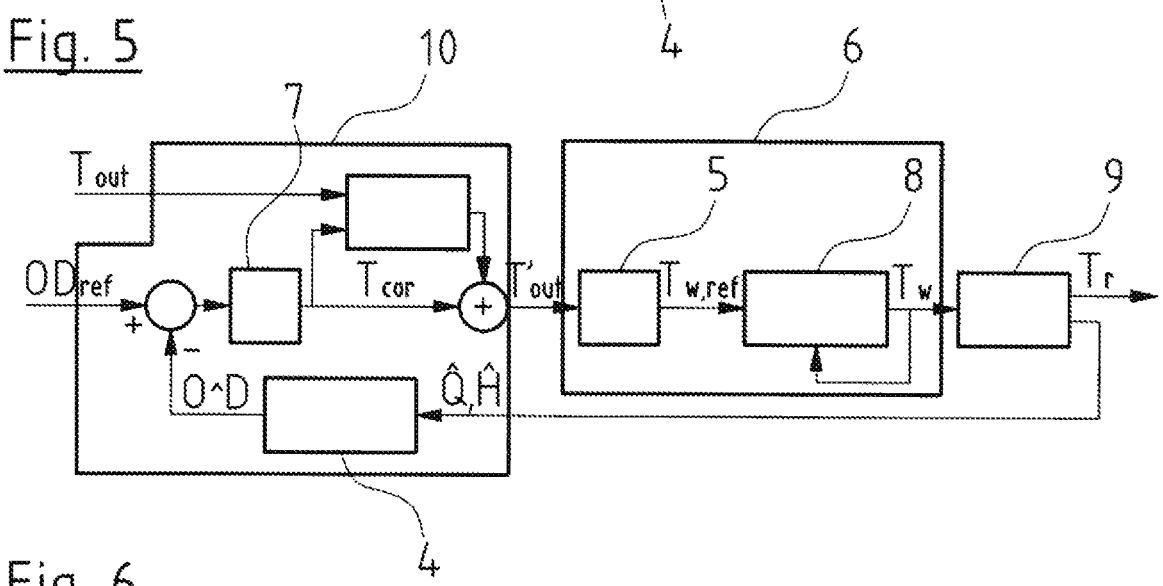
FIG. 5 is a view showing a control structure for a heat pump of a heating system according to still another embodiment of the present invention.

FIG. 5 shows a control structure for a heat pump 6 of a heating system 9 according to still another embodiment of the present invention. This again is a heat pump control structure with feedback from the entire heating system. The pump 10 provides an alternate temperature $T'_{out}$ to the heat pump 6. The heat pump 6 uses the alternate temperature $T'_{out}$ as input for the heat pump heat curve 5.

Both embodiments which are illustrated in FIG. 4 and FIG. 5 provide a short term adaptation to the heat demand. Sudden changes in temperature due, e.g., to free heat causes the radiator valves to change the opening degree OD. This, in turn, causes changes in the flow and head which is detected and used to correct the water temperature reference $T_{w,ref}$ with the correction temperature $T_{out}$. With the correction temperature there is also provided the ability to carry out a long term adaption to the house or building. The heat curve according to the current outside temperature $T_{out}$ is adjusted to the current water temperature setpoint. $T_{w,ref}$ thereby, the heat curve is adjusted to the house or building over time. This eliminates unnecessary high water temperatures, and provides the required heating energy with an optimal COP.

Figure 6:
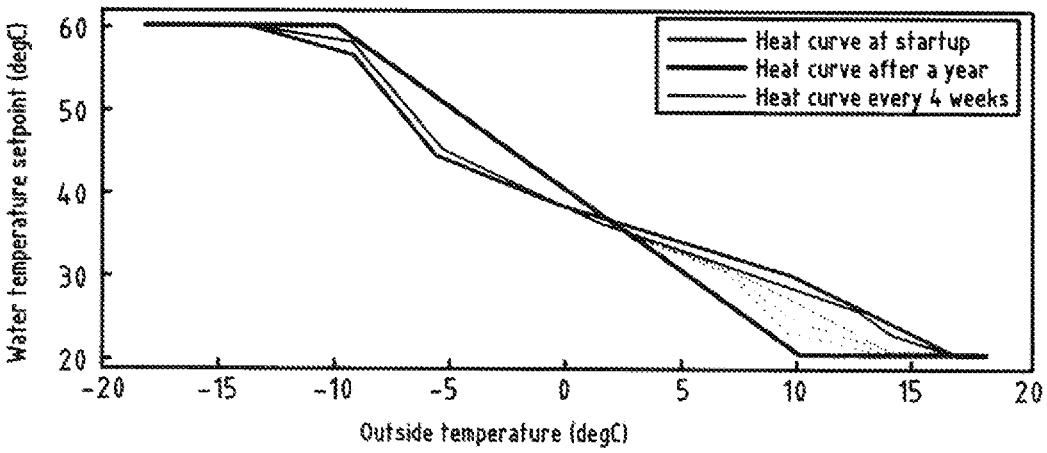
FIG. 6 is a diagrammatic view showing an adaptation of a heat curve according to the need of the heating system.

FIG. 6 shows a diagrammatic view of the adaptation of a heat curve according to the need of the heating system whereby the heat curve at startup, the heat curve after a year, and the heat curve every 4 weeks is displayed. The heat curve is automatically adapted to the need of the heating system. The heat curve adapts to the heat demand of the house according to the current outside temperature throughout the whole year.

The above described embodiments of the invention can be used in heating systems with changing media temperatures. The control system also works with heating systems with floor heating instead of radiators as the floor heating system provides the same feedback of the room temperatures. Further, the control system is not limited to heat pumps, but also may be implemented in other types of heating or cooling devices.

While specific embodiments of the invention have been shown and described in detail to illustrate the application of the principles of the invention, it will be understood that the invention may be embodied otherwise without departing from such principles.

APPENDIX

List of Reference Numerals

1 heat pump according to prior art
2 compressor according to prior art
3 heating system according to prior art
4 opening degree estimation means
5 heat curve
6 heat pump
7 regulator
8 compressor control
9 heating system
10 pump

What is claimed is:

1. A method for adjusting a setpoint temperature of a heat transfer medium circulating in a heating or cooling system inside a building or circulating in a heating or cooling system at least inside a surrounding part of a building, the method comprising the steps of:

providing a heating or cooling circuit comprising a plurality of heat transferring units, each of the plurality of heat transferring units being equipped with a temperature controlled valve;

determining a sum opening degree of all temperature controlled valves in a time dependent manner; and controlling the setpoint temperature of heat transferring medium according to a predetermined sum opening degree of all temperature controlled valves, the time dependent sum valve opening degree being based on an actual estimated hydraulic system resistance compared with an estimated minimum and/or maximum hydraulic system resistance, the estimation of the minimum and/or maximum hydraulic system resistance being based on estimated hydraulic systems resistances registered in the last 5 to 25 days, wherein the estimation of the minimum and/or the maximum hydraulic system resistance is provided by filtering peak values of a continuously determined hydraulic system resistance, wherein the sum opening degree of all temperature controlled valves is determined on the basis of at least one of a volume rate of flow and a pressure head through the heating or cooling circuit.

2. A method according to claim 1, wherein the setpoint temperature is also adjusted according to an outside temperature outside of the building.

3. A method according to claim 1, wherein the sum opening degree of all temperature controlled valves is determined from at least one of sensor based data and electrical data of a heating or cooling system pump.

4. A method according to claim 1, wherein the method provides a first phase when the minimum and maximum hydraulic system resistance are estimated and a second phase when the sum opening degree of all temperature controlled valves is determined.

* * * * *